US007258057B2

(12) United States Patent
Nagler et al.

(10) Patent No.: US 7,258,057 B2
(45) Date of Patent: Aug. 21, 2007

(54) METHOD AND APPARATUS FOR THE PRODUCTION OF MECHANICAL POWER FROM HYDRAULIC ENERGY

(75) Inventors: Ehud Nagler, Kiryat Tivon (IL); Zvi Yemini, Yafo (IL)

(73) Assignee: Hydro-Industries Tynat Ltd., Migdal HaEmek (IL)

( * ) Notice: Subject to any disclaimer, the term of this patent is extended or adjusted under 35 U.S.C. 154(b) by 237 days.

(21) Appl. No.: 10/506,252

(22) PCT Filed: Mar. 17, 2003

(86) PCT No.: PCT/IL03/00231

§ 371 (c)(1),
(2), (4) Date: Sep. 10, 2004

(87) PCT Pub. No.: WO03/078797

PCT Pub. Date: Sep. 25, 2003

(65) Prior Publication Data

US 2005/0113179 A1 May 26, 2005

(30) Foreign Application Priority Data

Mar. 18, 2002 (IL) ..... 148748

(51) Int. Cl.
*F01L 33/04* (2006.01)

(52) U.S. Cl. ..... 91/185

(58) Field of Classification Search ..... 91/176, 91/185, 352

See application file for complete search history.

(56) References Cited

U.S. PATENT DOCUMENTS 357,248 A * 2/1887 Todd ..... 91/176
1,825,462 A 9/1931 Link, Jr.
1,954,408 A 4/1934 Eliot
1,990,703 A * 2/1935 Ewart ..... 91/176
2,032,708 A 3/1936 Mallon
2,507,361 A * 5/1950 Widmer ..... 91/479
2,518,990 A 8/1950 Keener
2,989,605 A 6/1961 Leonard
3,055,170 A 9/1962 Westcott
3,309,795 A 3/1967 Helmore
3,381,317 A 5/1968 Daniels et al.
3,545,013 A 12/1970 Discoe (Continued)

FOREIGN PATENT DOCUMENTS

DE 2157735 5/1973
EP 136414 4/1985

*Primary Examiner*—F. Daniel Lopez

(57) ABSTRACT

The subject of the invention is an engine that is actuated by a fluid under pressure, preferably water, and comprises one or more oscillating, connecting-rod assemblies (13), including a cylinder (14) and a piston (15), and at least one or more cranks (16) driven by the connecting-rod assemblies (13). For each connecting-rod assembly (13), a preferably stationary valve (20) controls the feed and the discharge of the pressure fluid to and from it, synchronically with the angular position of the corresponding crank (10), and acts as the pivot about which connecting-rod assembly (13) oscillates. The engine can be applied for producing mechanical work in any apparatus, for example in sprinklers, concrete mixers, apparatus for winding cables or garden hose reels, and so on, or for the production of electrical energy. The actuating fluid can be used, after its discharge from the engine, for purposes for which high pressure is not required.

23 Claims, 18 Drawing Sheets

U.S. PATENT DOCUMENTS

| | | | | |
|---|---|---|---|---|
| 3,879,770 | A | 4/1975 | Grant | |
| 3,921,743 | A | 11/1975 | Parrish | |
| 4,101,005 | A | 7/1978 | Fewkes | |
| 4,492,372 | A | 1/1985 | Lorence et al. | |
| 4,681,550 | A | 7/1987 | Koenig | |
| 5,279,004 | A | 1/1994 | Walker | |
| 5,377,366 | A | 1/1995 | Boyd et al. | |
| 5,741,188 | A | 4/1998 | Levin et al. | |
| 2002/0007728 | A1* | 1/2002 | Montgomery | 92/140 |

* cited by examiner

METHOD AND APPARATUS FOR THE PRODUCTION OF MECHANICAL POWER FROM HYDRAULIC ENERGY

RELATED APPLICATIONS

This application is a National Phase Application of PCT/IL03/00231 having International Filing Date of Mar. 17, 2003, which claims priority from Israel Patent Application No. 148748, filed Mar. 18, 2002.

FIELD OF THE INVENTION

This invention relates to the production of mechanical power from hydraulic energy; in particular, it relates to an engine that is actuated by a fluid, preferably water, or gas, preferably air, under pressure. It further relates to a mechanism for actuating a shaft by means of a pressure fluid which comprises an oscillating, connecting-rod assembly and at least a crank driven by said connecting-rod assembly, as hereinafter defined. The invention further relates to the use of such a mechanism for actuating various mechanical apparatus. The invention further relates to a valve for controlling the feed and the discharge of pressure fluid to and from a connecting-rod assembly, synchronically with the angular position of the crank driven by said assembly.

BACKGROUND OF THE INVENTION

Fluid-actuated mechanisms for carrying out mechanical work are known in the art and have been described in a number of patents. U.S. Pat. No. 2,518,990 describes a fluid-actuated hose reel in a lawn sprinkler. U.S. Pat. No. 2,989,605 describes a water-powered retractable shower head. More recently, U.S. Pat. No. 5,741,188 discloses a ride-on toy or a garden tool which includes a stationary element, a movable element connected thereto, water pressure operating means for moving the movable element with respect to the stationary element, a water inlet and a water outlet, and a valve for controlling the flow of the water through the device.

European Application 136414 A2 discloses a water flow operated device for winding and/or unwinding a layer of flexible material which comprises a stationary element, a spool having a central axis, said spool being rotatable about a central axis when engaged with the stationary element; and a water flow-operated mechanism engaged by said stationary element for controllably rotating said spool.

Of particular interest to the present invention is Eliot U.S. Pat. No. 1,954,408 which discloses a fluid-driven engine, comprising: a drive unit connectable to a source of pressurized fluid and including a piston movable within a cylinder; a valve assembly controlling the introduction of pressurized fluid into the cylinder, and the discharge of spent fluid therefrom for driving the piston with respect to the cylinder; and a rotatable drive shaft including a crank arm coupled to the drive unit for rotating the drive shaft about a rotary axis; the piston projecting through one end of the cylinder and being pivotally coupled to the crank arm for rotating the drive shaft during forward and return strokes of the piston with respect to the cylinder; the opposite end of the cylinder being pivotally mounted to the valve assembly so as to oscillate with the piston between opposite sides of the drive shaft rotary axis during the forward and return strokes of the piston; the opposite end of the cylinder being formed with a port through which pressurized fluid is introduced and spent fluid is discharged as controlled by the valve assembly during the oscillations of the cylinder and piston.

OBJECTS AND BRIEF SUMMARY OF THE PRESENT INVENTION

An object of the present invention is to provide a fluid-driven engine of the type described in the above-cited U.S. Pat. No. 1,954,408, but having a number of advantages as will be described more particularly below. According to the present invention, therefore, there is provided a fluid-driven engine of the type described in U.S. Pat. No. 1,954,408, as set forth above, and as more particularly defined in the first part of accompanying claim 1, characterized in that the valve assembly includes a valve body of cylindrical configuration pivotally mounting the opposite end of the cylinder for pivotal movement about the longitudinal axis of the valve body; the valve body including a cylindrical surface serving as the pivotal mounting seat for the opposite end of the cylinder and formed with a pair of valve openings circumferentially spaced from each other so as to be selectively alignable with the port formed in the opposite end of the cylinder during pivotal movements of the cylinder for controlling the introduction of pressurized fluid into the cylinder and the discharge of spent fluid from the cylinder.

Thus, whereas the valve body in the Eliot Patent U.S. Pat. No. 1,954,408 is particularly described (and chimed) as being of spherical configuration, in the engine of the present application the valve body is of cylindrical configuration. Such a configuration provides a number of important advantages.

One important advantage is that the cylindrical valve seat defined by the valve body constrains all the movements of the cylinder and piston to axial force-transmitting movements, i.e., to movements parallel to the longitudinal axis of the cylinder which are effective to rotate the drive shaft, and prevents lateral movements of the cylinder and piston which not only decrease the efficiency of the engine, but also contribute to rapid wear of its parts. In addition, by providing the engine with a valve body having a cylindrical seat, rather than a spherical seat, the valve openings may be elongated in the axial direction of the valve body, and in addition sealing rings may be provided, to produce a more efficient transfer of the pressurized fluid from the valve body to the cylinder, and of the spent fluid from the cylinder back to the valve body for discharge therefrom. Further, making the valve body of a cylindrical configuration better enables a plurality of such drive units to be assembled in a modular fashion, according to the requirements of any particular application, for driving a common drive shaft.

According to further features in the preferred embodiments of the invention described below, the valve openings are of relatively long length in the axial direction of the cylindrical surface of the valve body (FIGS. 4, 5, 13) and of relatively narrow width in the circumferential direction of the cylindrical surface of the valve body. As indicated above, this feature provides a more efficient transfer of the fluid between the valve body and the cylinder.

According to still further features in some described preferred embodiments, the valve body includes a cap for at least one of said valve openings, and an elastomeric sleeve between the valve body and the cap for urging the cap against the surface of said cylinder pivotally mounting the cylinder and piston to the valve body.

This feature provides an effective seal between the valve body and the cylinder during the pivotal movements of the cylinder.

According to still further features in some described preferred embodiments the engine comprises a plurality of at least three drive units each including a piston movable within a cylinder; and a valve assembly for each of the drive units for controlling the introduction of pressurized fluid into the cylinder of the respective drive unit and the discharge of spent fluid therefrom for driving the piston of the respective drive unit; each of the pistons being coupled to the drive shaft such that the pistons initiate their respective forward strokes at different angular positions of the drive shaft.

Such a construction eliminates the need of a fly wheel, as would be required in Eliot. Preferably, the pistons are coupled to the drive shaft such as to initiate their respective forward strokes at equally-spaced angular, positions of the drive shaft.

According to one preferred embodiment described below, the drive units and valve assemblies are each arranged in a linear array with the valve assembly at one end of the respective drive unit and in abutting relation to the valve assembly of the adjacent drive unit, and with the drive shaft coupled to the pistons at the opposite ends of the drive units. In the described embodiment, the pistons of the drive units are coupled to the drive shaft via a crank shaft which includes a crank arm for each piston. Such a construction thus permits any desired number of drive units to be coupled to the drive shaft in a modular manner according to the force requirements for any particular application.

Other embodiments are described below wherein the drive units and valve assemblies are arranged in a radiating array with the valve assembly at the outer end of the respective drive unit and pivotally coupled to the cylinder of the respective drive unit, and with the drive shaft at the inner ends of all the drive units and coupled to the pistons of all the drive units. Preferably, the drive shaft includes a single crank arm to which the pistons of all the drive units are pivotally coupled. Such a construction is particularly advantageous in that it permits the drive units to be coupled, in a convenient and compact manner, to a common drive shaft of a rotary device, such as a cement mixer, a rotary fan, or a rotary reeling device.

Traditional connecting-rod-crank mechanisms must be provided with control means for admitting pressure fluid, in many cases compressed air or steam, to the cylinder and discharging said pressure fluid from it. If more than one connecting-rod were provided, a plurality of control means would have to be provided and synchronized, as required, to impart a rotational impulse to the crank at appropriate stages of its swinging motion. In the mechanism of the invention, the admission and discharge of the pressure fluid are controlled in each connecting-rod assembly by a valve, preferably a stationary valve which also operates as a pivot, and therefore are automatically synchronized with the stages of the crank rotation.

In more detail, the preferred: form of the mechanism of the invention comprises a crank rotatably connected to a shaft either because it is solid with it, or is keyed to it, or is a part of a crankshaft. The connecting-rod assembly comprises a cylinder, which has a pivotal connection to the crank, preferably wherein the cylinder is provided with a pivot seat, such as an annular one, while the crank is provided with a pivot pin or is part of a crankshaft which engages the pivot seat, the opposite being equally possible. The cylinder is provided with a pivot seat or surface, preferably being cylindrical or a segment of a cylinder, which has an aperture providing a communication with the inside of the cylinder. The aperture may be a single, preferably an elongated, one, or may be constituted by a plurality of openings, e.g., circular openings arranged one after the other along a line, in which cases it will be called herein "composite aperture". In a preferred embodiment of the invention the aperture, whether single or composite, is arranged on a transverse axial line or is symmetric with respect of said line. "Transverse axial line" means herein the intersection of the pivot seat of the connecting-rod assembly cylinder with the plane of symmetry of the cylinder that passes through the axis of symmetry of the pivot pin of the crank and the pivot seat of the connecting-rod: assembly. It is preferred that said aperture of said pivot seat, whether single or composite, be symmetric to said transverse axial line, but it is possible that it be not so symmetric but arranged on a line that is symmetric with respect to said transverse axial line, as will be better explained later on.

The mechanism, in its preferred form, further comprises a stationary valve, the body of which is partly hollow, and which comprises an outer pivot surface slidingly engaged by the pivot seat of the connecting-rod assembly cylinder. Said pivot surface is a part of a cylinder or consists of parts of a cylinder, while the remaining part of the outer surface of the valve body may have a different shape. The valve body has a first and a second aperture communicating with its inner hollow, and which are preferably longitudinal, viz. symmetric with respect to an axial plane of the valve body, but in general are so shaped that they may be juxtaposed to said aperture of the pivot seat of the connecting-rod assembly cylinder. Each of the valve body apertures communicates, through inner channels of the valve body, with a respective port. One of the two ports is in communication with a source of pressure fluid and the other one with or a fluid discharge respectively, and thus communication is established between the respective apertures of the valve body and said pressure fluid source or fluid discharge, respectively. In some applications, as will be explained hereinafter, the functions of the two ports are periodically switched, viz. each communicates alternatively with said source of pressure fluid and with said fluid discharge. In other applications, one of the ports communicates always with said source of pressure fluid and the other communicates always with said fluid discharge.

As the connecting-rod assembly oscillates, its angular position shifts from one extreme end to another extreme end. The first and second apertures of the valve body are angularly spaced by the same angle as the two extreme positions of the connecting-rod assembly. At a given angular position of said assembly, generally at the center or near the center of its oscillation, the aperture (whether single or composite, viz consisting of several openings close to one another) of said pivot seat or surface of the cylinder of the connecting-rod assembly is juxtaposed to an unapertured portion of the valve body. As said assembly oscillates, said aperture of said pivot seat or surface becomes gradually juxtaposed to one (first juxtapositions or to the other (second juxtaposition) of the apertures of the valve body. In the first juxtaposition, the inside of the cylinder is placed in gradually increasing communication with a source of pressure fluid which is fed to the inside of the cylinder, and therefore the piston is subjected to an axial force which it transmits to the crank or crankshaft as a rotational impulse. In the second juxtaposition, the inside of the cylinder is placed in gradually increasing communication with the discharge, there is gradually decreasing resistance to the motion of the piston, and the fluid is gradually discharged from the cylinder. At one of the extremes of the oscillation of the connecting-rod assembly, said first juxtaposition is complete or at least at a maximum, and said piston is subjected to a maximum axial force; at the opposite extreme, and the discharge of the fluid from said cylinder is complete or at least as complete as it will be. Said operative phases will be further described hereinafter, with reference to FIG. 18.

For the sake of clarity, the outwardly or projecting motion of the piston, with respect to the cylinder, from its innermost or most retreated position to its outermost or most extended position, during which it transmits to the crank a rotational impulse, will be called the positive or active stroke, and the inwardly or retreating motion of the piston from said outermost to said innermost position, during which it discharges the fluid from the cylinder, will be called the negative or passive stroke. As will be explained in detail hereafter, the choice of which port communicates with a source of pressure fluid and which communicates with a discharge depends on the phases of the swinging motion of the crank, and is established so as to impart to the crank a rotational impulse when this is desired and allow it to continue freely in its swinging motion when-no further impulse is to be transmitted from the respective connecting-rod. It will be understood that, if the shaft connected to the crank always rotates in the same direction, one port will always be in communication with the source of pressure fluid and the other port will always be in communication with the discharge. However, if the shaft is to rotate alternatively in opposite directions, the ports will periodically switch their aforesaid communications.

In one of the preferred embodiments of the invention, the crank is associated with a plurality of connecting-rod assemblies, which are angularly spaced, preferably by the same angle. Each connecting-rod assembly has an angular position that can be called the "null" or "zero angle position", which is the position at which the axis of the piston of the connecting-rod assembly and the radius of the crank are aligned. Actually, there are two such positions, in one of which the piston is at its greatest retraction, while in the other it is in its greatest extension. When it is said herein that various connecting-rod assemblies are angularly spaced from one another, what is meant is that the null angle positions thereof are angularly spaced from one another. Preferably, the angular spacing is uniform, but this is not necessary and dynamic considerations may suggest a different angular spacing. Since in a preferred embodiment of the invention three connecting-rod assemblies are provided, any two of them are adjacent to one another and are spaced from one another by 120° or by any other chosen angle. The connecting-rod assemblies, however, when a plurality of them is present, need not be at an angle to one another but may be linearly spaced, viz. placed one next to the other in such a way that the axes of their null angle positions are all coplanar, parallel to one another in the common plane, and displaced from one another perpendicularly to their common direction. In this case, each connecting-rod assembly operates on a different crank and all the cranks are part of a crankshaft. An apparatus in which the connecting-rod assemblies are linearly spaced is also a preferred embodiment.

Another aspect of the invention is the provision of an apparatus for the production of mechanical work from hydraulic energy, which comprises a source of pressure fluid and a mechanism for actuating at least one rotatable shaft from the said pressure fluid, as hereinbefore described.

Preferably, the invention also comprises the use of the mechanism hereinbefore described for producing mechanical work the mechanism can be applied for producing mechanical work in any apparatus. Among such applications are, for example, sprinklers, mixers, in particular concrete mixers, apparatus for winding cables or garden hose reels, for spreading pool covers, for actuating shading canvases, valve control motors, robots for cleaning swimming pools, ride-on garden toys, cooling fans, rotary watering filters, and the like. The mechanism can also be used for the production of electrical energy, viz. can be coaxial with or otherwise drive an electricity generator it should be noted that, in some cases of engines according to the invention, the actuating fluid can be used, after its discharge from the engine, for other purposes for which only a low pressure or no pressure at all is required. For instance, if the fluid is water, the discharged water may be used in water sprinklers, drip systems, humidification of cooling fans, supplying water to cement mixers, and the like. Such a further use and the resulting apparatus are also aspects of the invention.

DETAILED DESCRIPTION OF PREFERRED EMBODIMENTS

Figure 1C:
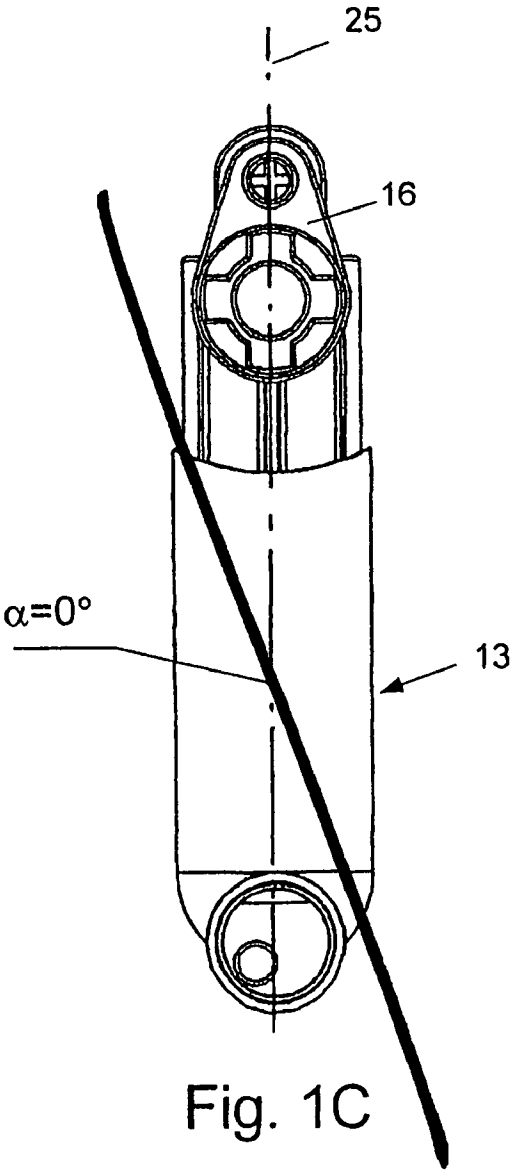
FIGS. 1A, 1B and 1C illustrate the motion of the connecting-rod assembly during the phase of the rotation of the crank in which a rotational impulse is to be transmitted to said crank, according to an embodiment of the invention.
Figure 1B:
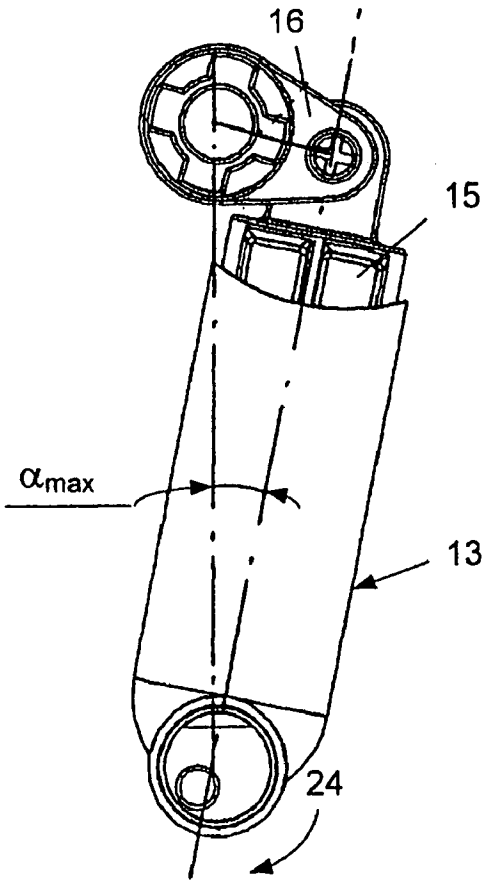
Figure 1A:
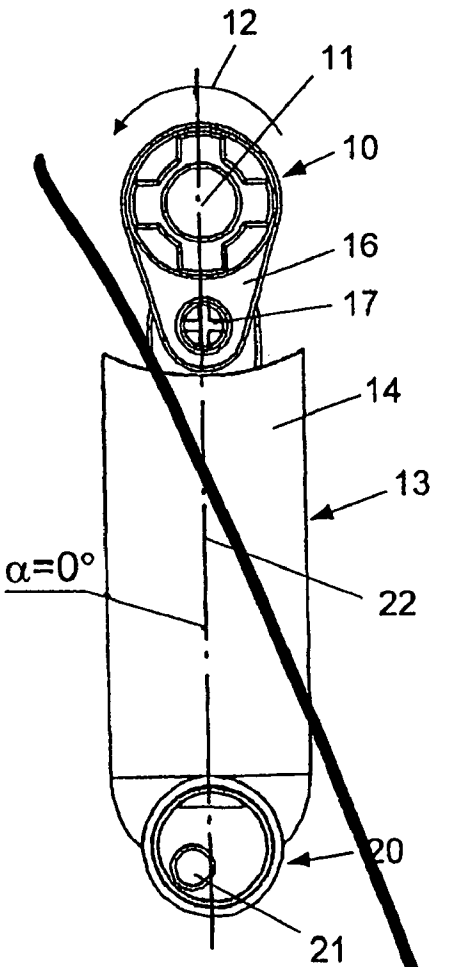
Figure 2C:
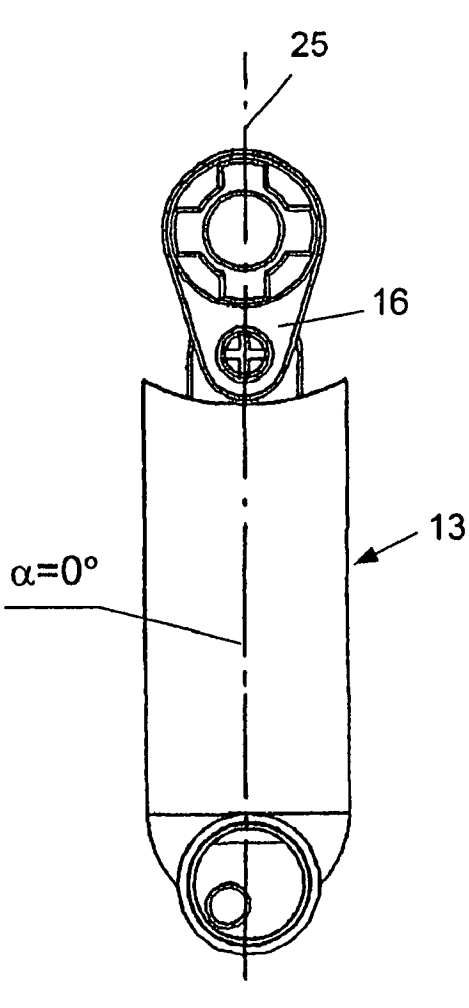
FIGS. 2A, 2B and 2C illustrate the motion of the connecting-rod assembly during the phase of the rotation of the crank in which no impulse is to be transmitted to said crank, according to the embodiment of FIG. 1.
Figure 2B:
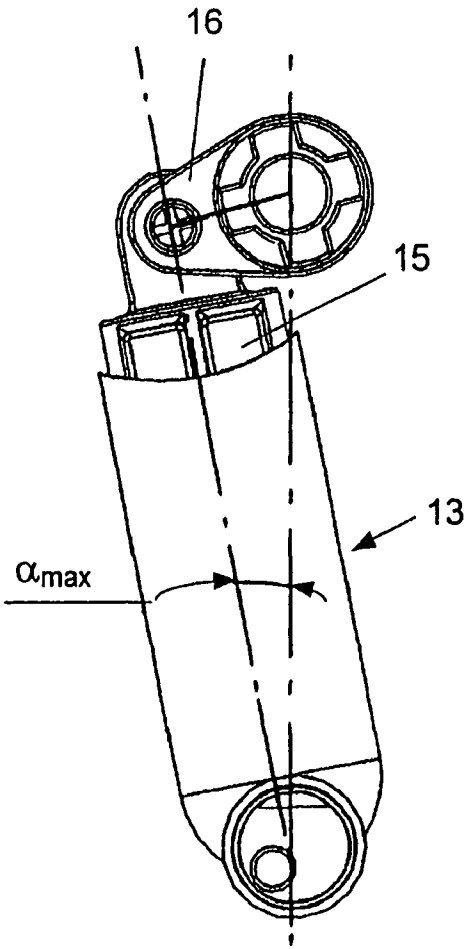
Figure 2A:
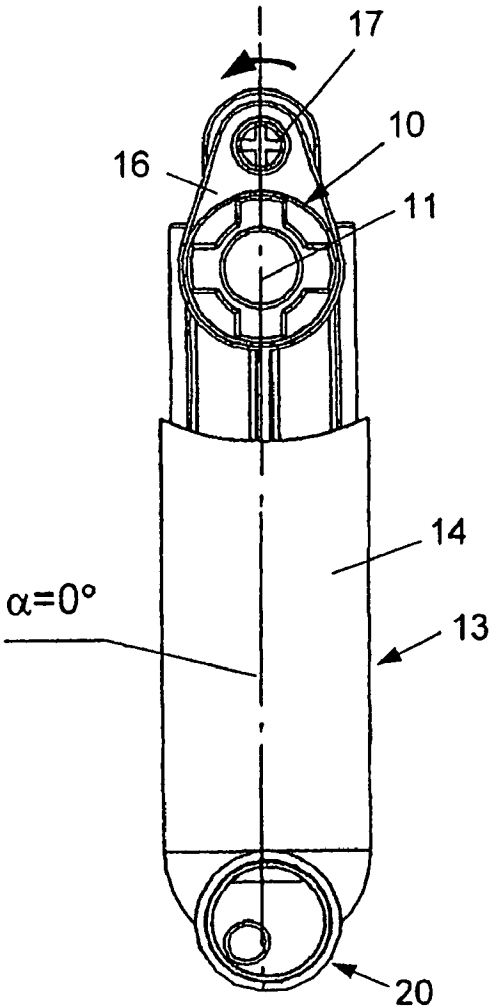

The operation of a connecting-rod assembly according to an embodiment of the invention will be understood with reference to FIGS. 1A, B, C and FIG. 2A, B, C. FIGS. 1 illustrate the motion of the connecting-rod assembly during the phase of the rotation of the crank in which a rotational impulse is to be transmitted to said crank. During said phase, the piston of said assembly moves in its positive or active stroke. FIGS. 2 illustrate the motion of the connecting-rod assembly during the phase of the rotation of the crank in which no impulse is to be transmitted to said crank. During said phase, the piston of said assembly moves in its negative or inactive stroke.

As seen in FIG. 1; numeral 10 indicates a shaft, which rotates, together with a crank 16, solid with it or keyed to it, about an axis 11 in the direction indicated by the arrow 12. 13 generally indicates the connecting-rod assembly. 14 is the cylinder of said assembly and 15 is the piston. Piston 15 is connected to crank 16 by a pivotal connection generally indicated at 17.

The connecting-rod assembly 13 is pivoted to a stationary valve 20, only one end of which is visible in FIG. 1, showing port 21 which communicates either with the source of pressure fluid or with the discharge. Another port communicates with the discharge or with a source of pressure fluid, respectively, and can be provided on the opposite end (not visible in the drawing) of the valve.

In FIG. 1A the connecting-rod assembly 13 is in its first null angle position, which will be called herein the "retracted" null angle position, or briefly, "the retracted position". Line 22, which is the trace on the drawing of the plane of symmetry of cylinder 14 and piston 15, passes through the axis of the shaft 10. The valve axis, the crank axis and the shaft axis are on one plane. Piston 15 is retracted inside cylinder 14 as far as it will go. As crank 16 rotates as shown by arrow 12, connecting-rod assembly 13 rotates in an opposite direction, as shown by arrow 24, about valve 20, which acts as a stationary pivot.

In the position of FIG. 1B, the connecting-rod assembly has rotated by an angle $\alpha$, which is the maximum one. Piston 15 has accomplished part of its active stroke.

As the motion of the mechanism continues, as shown in FIG. 1C, it reaches its second null angle position, which will be called herein the "extended" null angle position, or briefly, "the extended position". The center of valve 20, the axis of cylinder 14, the axes of piston 15, of shaft 10 and of pivot connection 17 are all on the same plane, the trace of which on the drawing is indicated at 25. The active or active stroke of piston 15 has come to an end.

FIG. 2 shows the second phase of the operation of the connecting-rod assembly. At the starting point, in FIG. 2A, it is in its extended null angle position, as in FIG. 1C. In FIG. 2B, it is in a position symmetric to that of FIG. 1B. The piston 15 has reentered partly into cylinder 14, and they both have reached the outermost angular deviation of the connecting-rod assembly from its null angle positions, indicated by an angle $\alpha$ symmetric to that of FIG. 1B.

As the motion of the mechanism continues, piston 15 accomplishes its negative or passive stroke and retracts into cylinder 14 as far as it can go. At FIG. 2C, the apparatus has reached the same position as in FIG. 1A, viz. its retracted null angle position.

It is apparent therefore that pressure fluid, particularly water, must be introduced into cylinder 14 while it swings from the position of FIG. 1A to that of FIG. 1C, and must be discharged while it swings from the position of FIG. 2A (the same as that of FIG. 1C) to that of FIG. 2C (the same as that of FIG. 1A).

Figure 3:
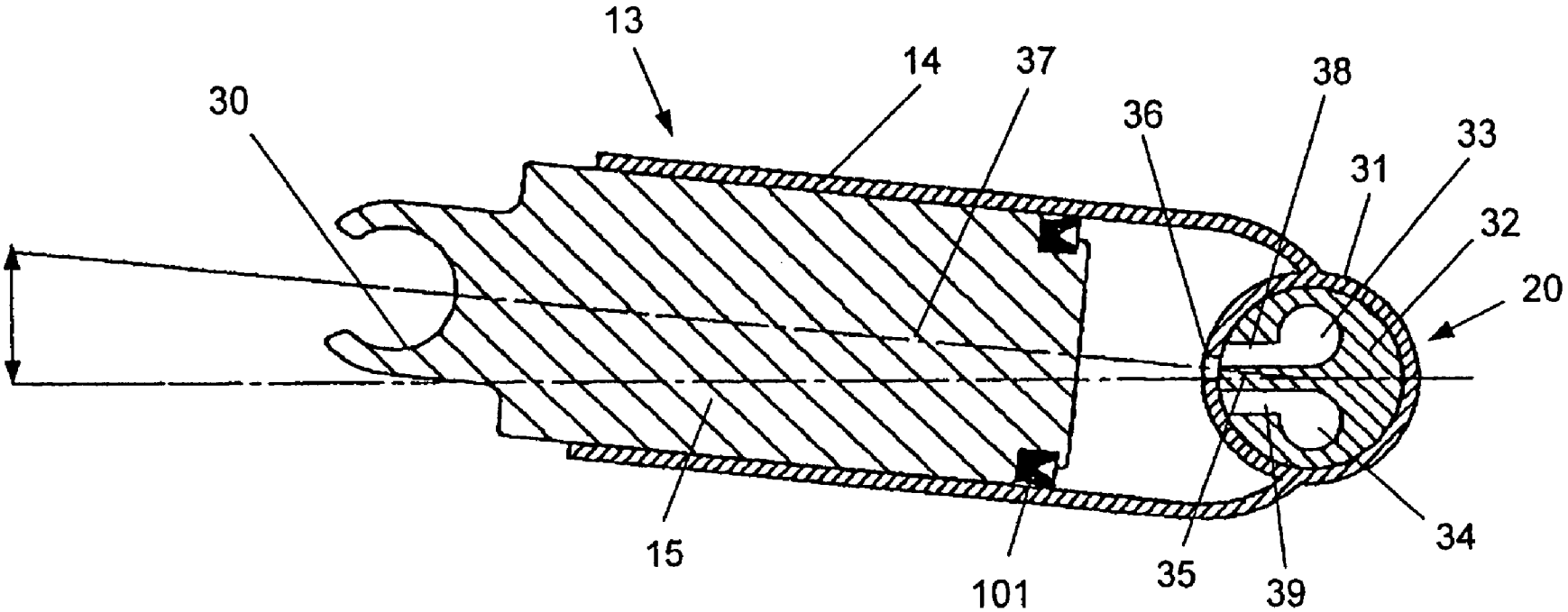
FIG. 3 is a schematic cross-section of the connecting-rod assembly and the valve, axial with respect to the assembly and transverse with respect to the valve, according to an embodiment of the invention.

FIG. 3 generally illustrates, in a cross-section that is axial with respect to connecting-rod assembly 13 and the valve 20. The assembly 13 comprises a cylinder 14 and a piston 15, provided with a sealing ring 11. (see also FIG. 11). Numeral 30 indicates a cylindrical surface, spanning an arc of about 240°, which serves as a pivot seat for a pivot pin driven by the crank 16. This embodiment is desirable when the piston is made of plastic matter, because then the pivotal connection between the piston 15 and the crank 16 may be obtained by snapping surface 30 over the pivot pin driven by the crank 16. In other embodiments, such as that of FIG. 4, the pivot seat is a fill ring and must be slid over the pivot pin. The cylinder 14 of the connecting-rod assembly terminates with a transverse cylindrical portion 31. By 'transverse cylindrical portion" is mean therein a portion of a cylinder the axis of which is parallel to the axis about which the connecting-rod assembly oscillates. Within said cylindrical portion 31 is inserted a valve body 32 and said portion 31 is open, at least at one end, to permit the introduction of said valve body. Said cylindrical portion 31 has an aperture 36, through which fluid may be fed into the cylinder 14 or discharged therefrom. Said aperture may be single and preferably symmetric about a central transverse line which is the intersection of said cylindrical portion with a plane of symmetry of the connecting-rod assembly passing through the axis about which the connecting-rod assembly oscillates and the axis of the crank pin. Said aperture may be composite, viz. consisting of a plurality of openings close to one another and centered on said central transverse line. Optionally, however, though less preferably, it could be arranged about a line slanted with respect to said central transverse line, or about a curved line, said slanted or curved line being symmetric with respect to said central transverse line.

Figure 18:
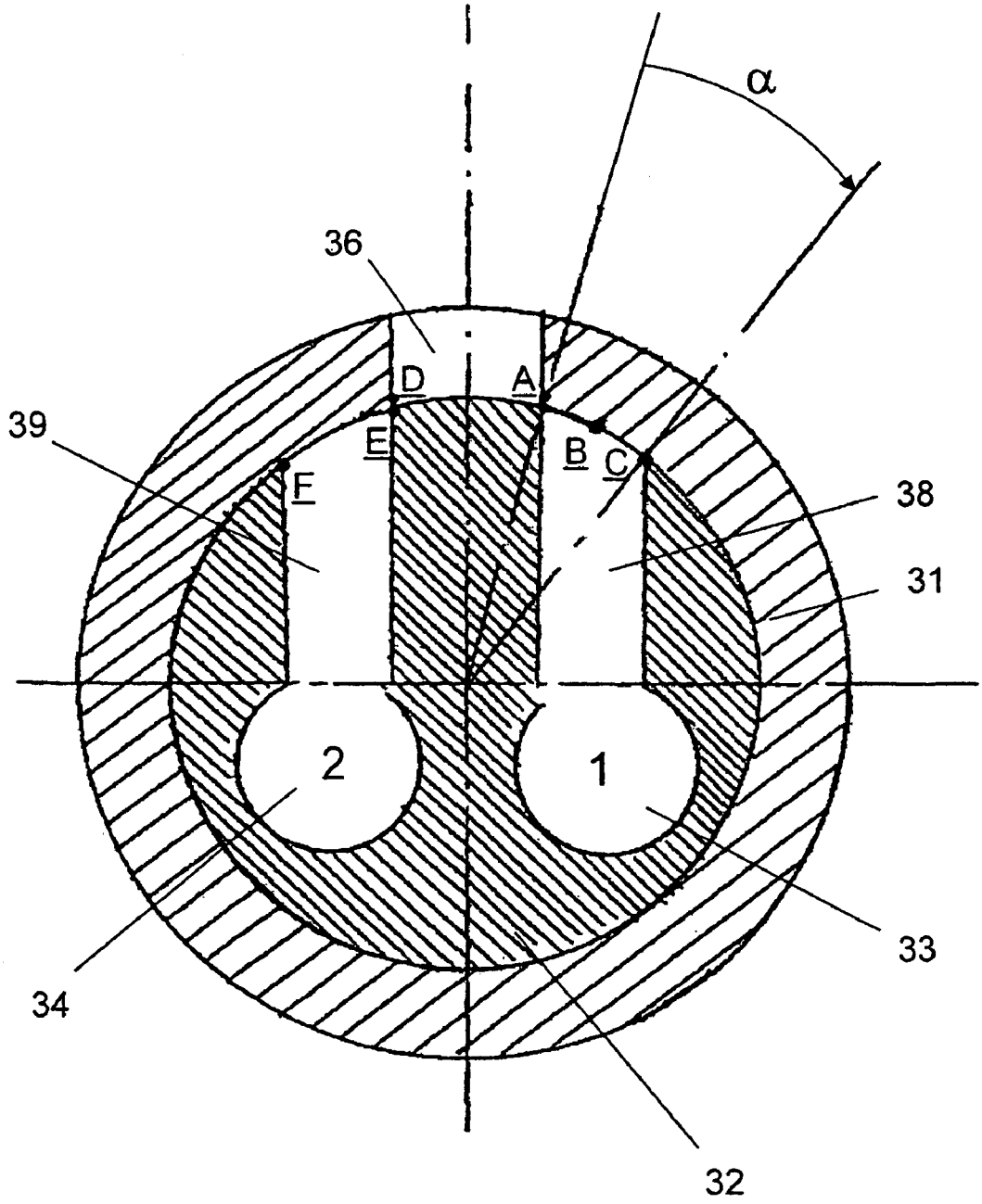
FIG. 18 is an enlarged cross-section of the valve body, illustrating the phases of its operation.

In FIG. 3, the cylinder 14 of the connecting-rod assembly, is shown in a position in which aperture 36 of cylindrical sleeve 31 overlaps partially aperture 38 of the valve body and partially a rib 35 of the valve body 32. In either of the null angle positions (only one of them being marked in the drawing) the aperture 36 would be placed on a line 37 which coincides with line 22 of FIG. 1A, and would be stoppered (closed) by said rib 35. As the connecting rod assembly swings one way or the other from a null angle position, the aperture 36 comes into gradually increasing juxtaposition to one or the other of two apertures 38 and 39 of the valve body. The phases of said juxtaposition are illustrated in the enlarged cross-section of the valve body 32 in FIG. 18, wherein the cylindrical portion 31 is in its central position and the aperture 36 is closed by rib 35 of valve body 32 (see FIG. 3). As said cylindrical portion 32 swings clockwise (as seen in FIG. 18) in the oscillation of the connecting-rod assembly, aperture 36 gradually overlaps aperture 38 of the valve body, until, after clockwise rotation by an angle $\alpha$, point A coincides with point C, or is as close as possible to it, and the overlapping of aperture 36 with aperture 38 reaches a maximum. If said cylindrical portion 32 swings counterclockwise. (as seen in FIG. 18), said overlapping decreases until it is annulled in the central position shown in the figure, and as the counterclockwise rotation continues, aperture 36 gradually overlaps aperture 39 of the valve body, until, after counterclockwise rotation by an angle $\alpha$, point D coincides with point F, or is as close as possible to it, and the overlapping of aperture 36 with aperture 39 reaches a maximum.

Apertures 38 and 39 are in communication with inner channels 33 and 34 which lead to opening 21, or to an equivalent opening, not shown in the drawing, and located on the opposite side of the valve. One of these ports is in communication with a source of pressure fluid, while the other port is in communication with the discharge; but, as has been said hereinbefore, in some embodiments said communications may be periodically switched. Switching of communications causes the inversion of the motor direction of rotation. Aperture 36 of the connecting-rod cylinder becomes gradually juxtaposed to one of openings 38 and 39, as has been explained, during the swinging of the connecting-rod assembly between the two maximum angular deviations shown in FIG. 1B and FIG. 2B, and becomes juxtaposed completely or to the maximum degree at either of the said two extreme angular positions which the cylinder 14 may assume. It is seen therefore that when the mechanism swings towards the position of FIG. 1B, pressure fluid will be gradually admitted through one of the apertures 38 or 39, while, when the mechanism swings towards the position of FIG. 2B, pressure fluid will be gradually discharged through the other of said apertures.

Figure 4:
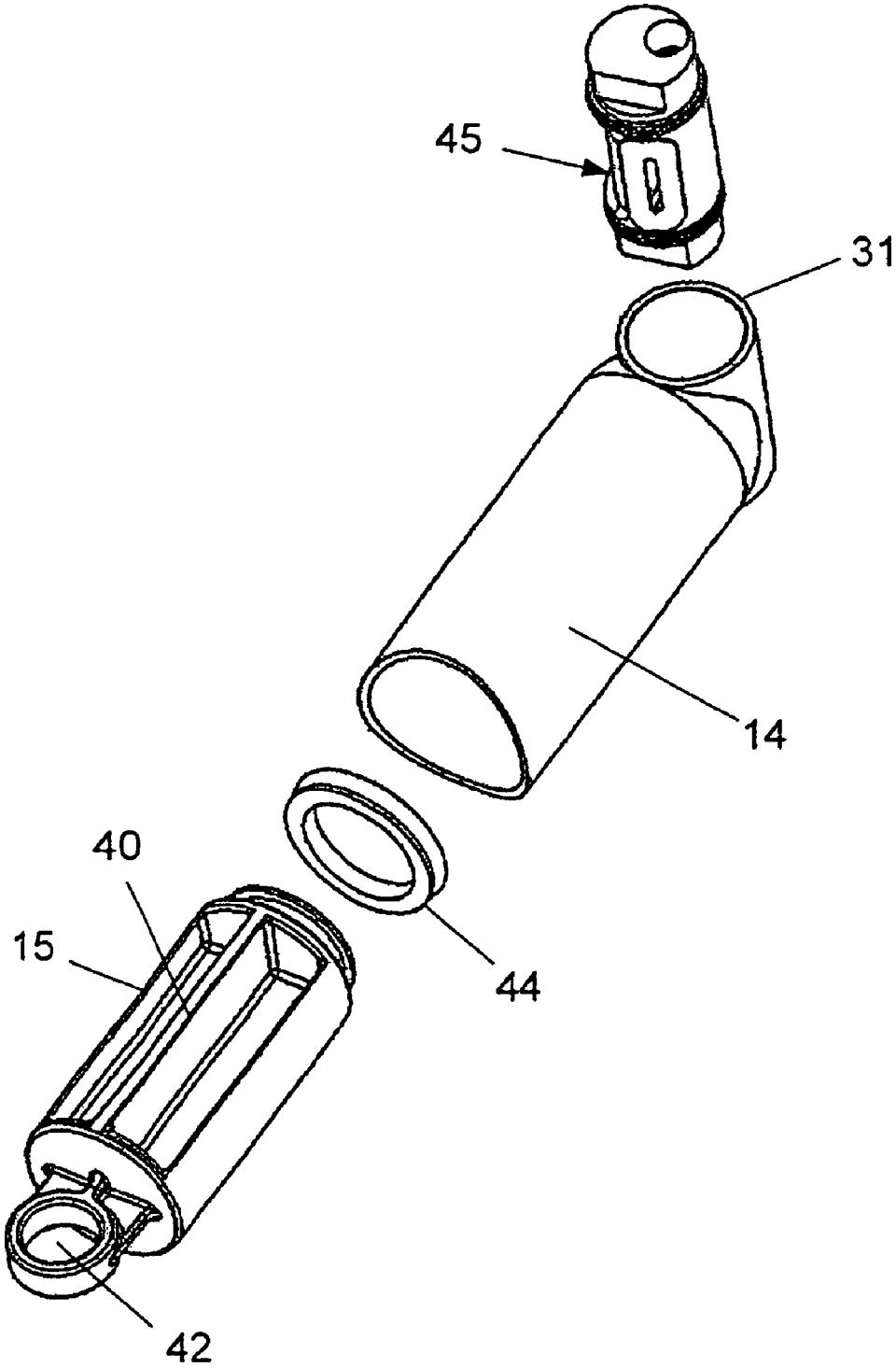
FIG. 4 illustrates in exploded perspective the relationship between the connecting-rod assembly and the valve, according to an embodiment of the invention.
Figure 11:
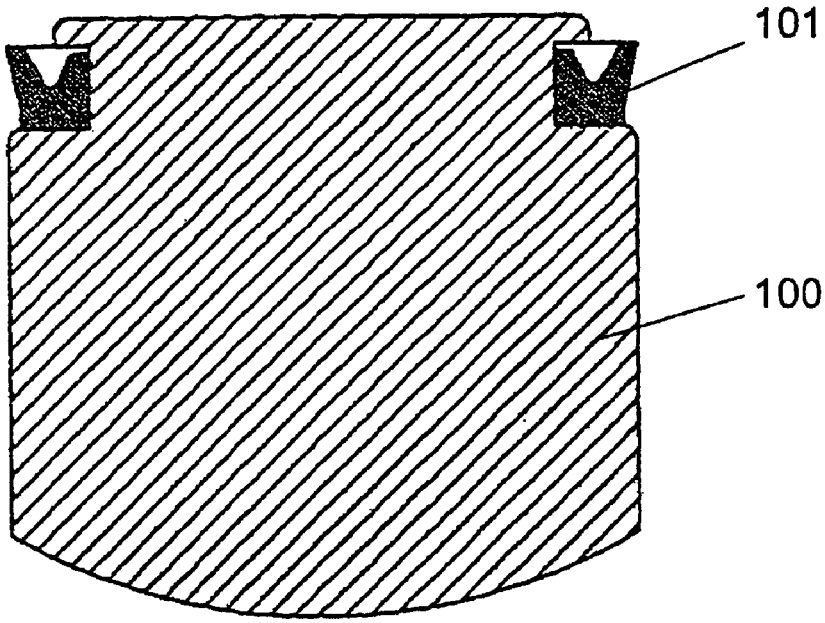
FIGS. 11 and 12 are schematic cross-sections of pistons of the connecting-rod assembly, according to two embodiments of the invention.
Figure 12:
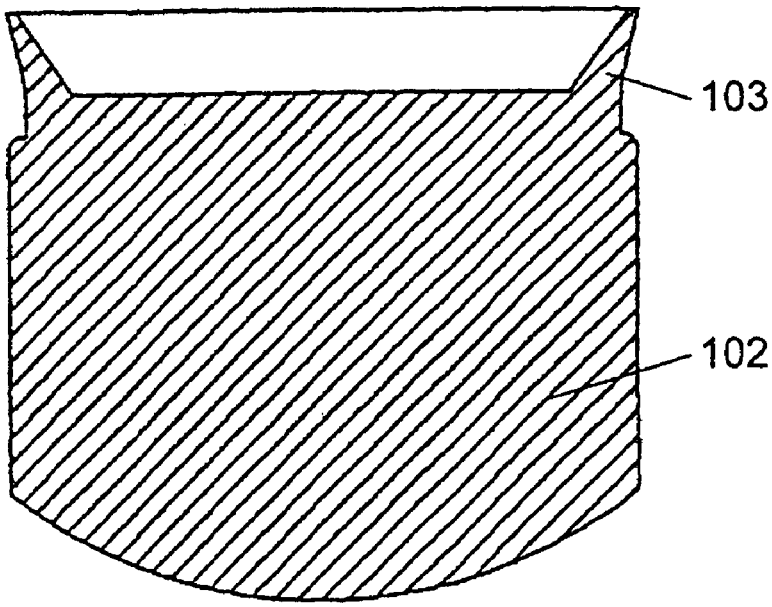

FIG. 4 is a further illustration in exploded perspective of the relationship between the connecting-rod assembly and the valve. Piston 15 is seen as outside of cylinder 14. In this and in other figures, the piston is seen as not as solid as in FIG. 3, but as formed by a number of longitudinal ribs 40, which is desirable for the purpose of lightening the apparatus, particularly in plastic pieces in which thin flat portions are preferred. 42 is the pivot seat, shown herein as ring-shaped. Elastomeric seals, such as seal ring 44, are provided to assure that the fluid should not pass around or through the piston from the bottom of cylinder 14 through which it is admitted or discharged. FIGS. 11 and 12 schematically show in cross-section two ways for producing a seal in plastic pistons. The piston body is shown as full in these figures, but this representation is only schematic and the piston will have any desired cross-section. In FIG. 11, the piston generally indicated at 100, is provided with an annular rubber seal 101. In FIG. 12, the piston 102 has a flexible edge 103, which serves as a seal, and is an integral part of the piston. The valve body, generally indicated in FIG. 4 at 45, is illustrated as being outside the cylindrical seat 31, in which it is received during the operation of the device.

Figure 5:
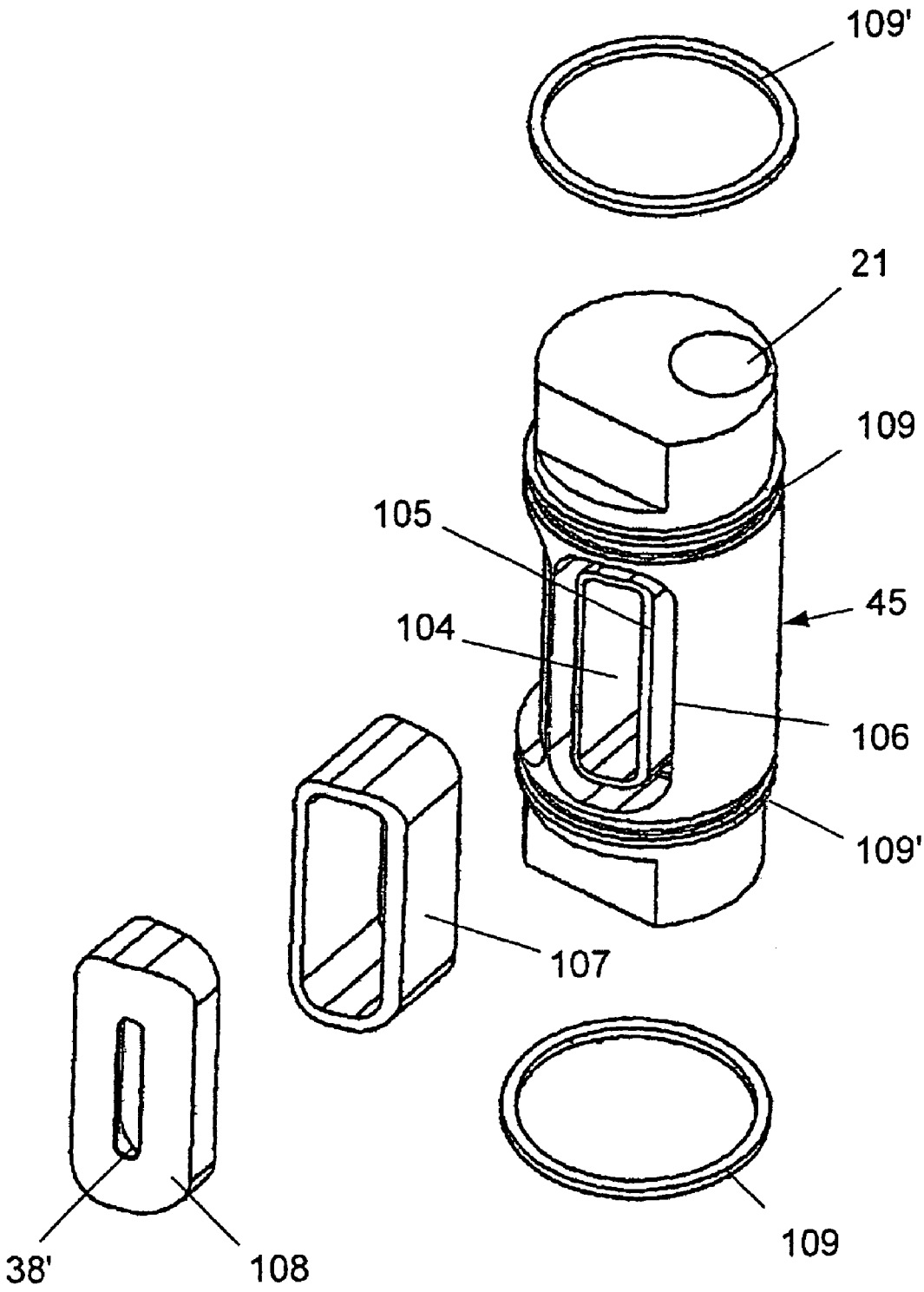
FIG. 5 illustrates in perspective view the valve of FIG. 4, which relates to a motor that rotates in one direction.
Figure 19:
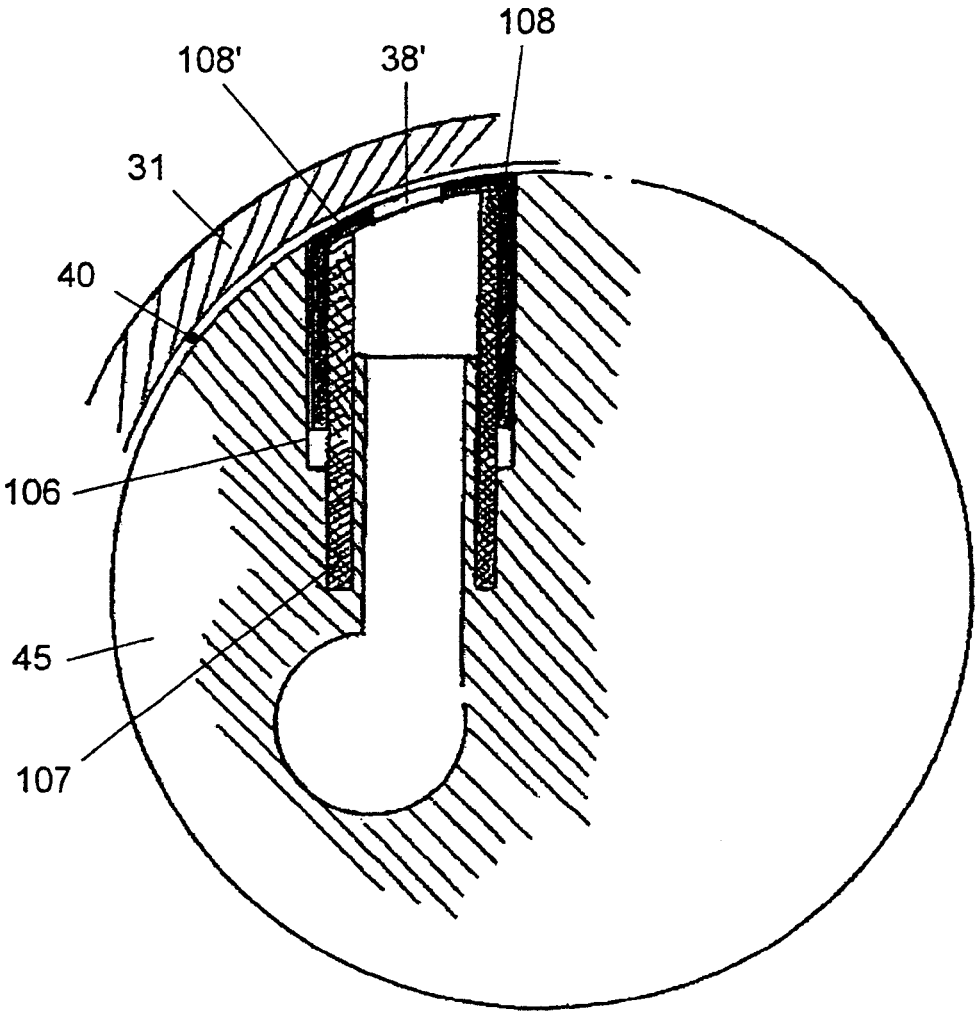
FIG. 19 is a cross-sectional detail of the valve body, illustrating a device for preventing leakage of fluid under pressure.

The valve body 45 is better illustrated in FIG. 5. It is shown herein as partly cylindrical in order to provide smooth motion of the sleeve 31 about the body 45 of the valve. 109 and 109' are two seal rings. If the valve body is precise in its shape and dimensions, as it may be if it is made of metal it will closely fit sleeve 31 and there will be no fluid leakages. However, if it is not precise in its shape, particularly when made of plastic, additional means must be provided to prevent leakage at least about the aperture 38 (or 39) through which passes actuating fluid under pressure, although leakage may not be a serious danger when the fluid flows to the discharge. A means for this purpose is illustrated in FIGS. 5 and 19. FIG. 19 is an enlarged cross-section of a single aperture 38' of the valve body, the rest of said valve body being omitted. The cylindrical portion 31 of the connecting-rod assembly cylinder and the valve body 45 do not match precisely and a gap 40 exists between them. The aperture 38' through which passes actuating fluid under pressure, indicated at 104, has an edge 105 spaced from the edge 106 of a broader opening of the valve body (see FIG. 5). An elastomeric sleeve 107: fits tightly over edge 105. A rigid cap 108, e.g. of plastic, having a very thin radial wall 108', fits tightly over elastomeric sleeve 107, but can slide over edge 106. It is provided with an aperture, indicated at 38' because it has the function of the previously described aperture 38 (or 39). The elastomeric sleeve 107 pushes the rigid cap 108 outwardly until the radial wall 108' of the cap is flush with the valve body surface. Sleeve 107, therefore, functions as a spring forcing cap 108 outwardly and as a seal between the cap and the valve body, while the radial wall 108' of the cap functions as a diaphragm urged by the fluid pressure against the inner surface of the cylindrical part 31, whereby to improve sealing.

Figure 13:
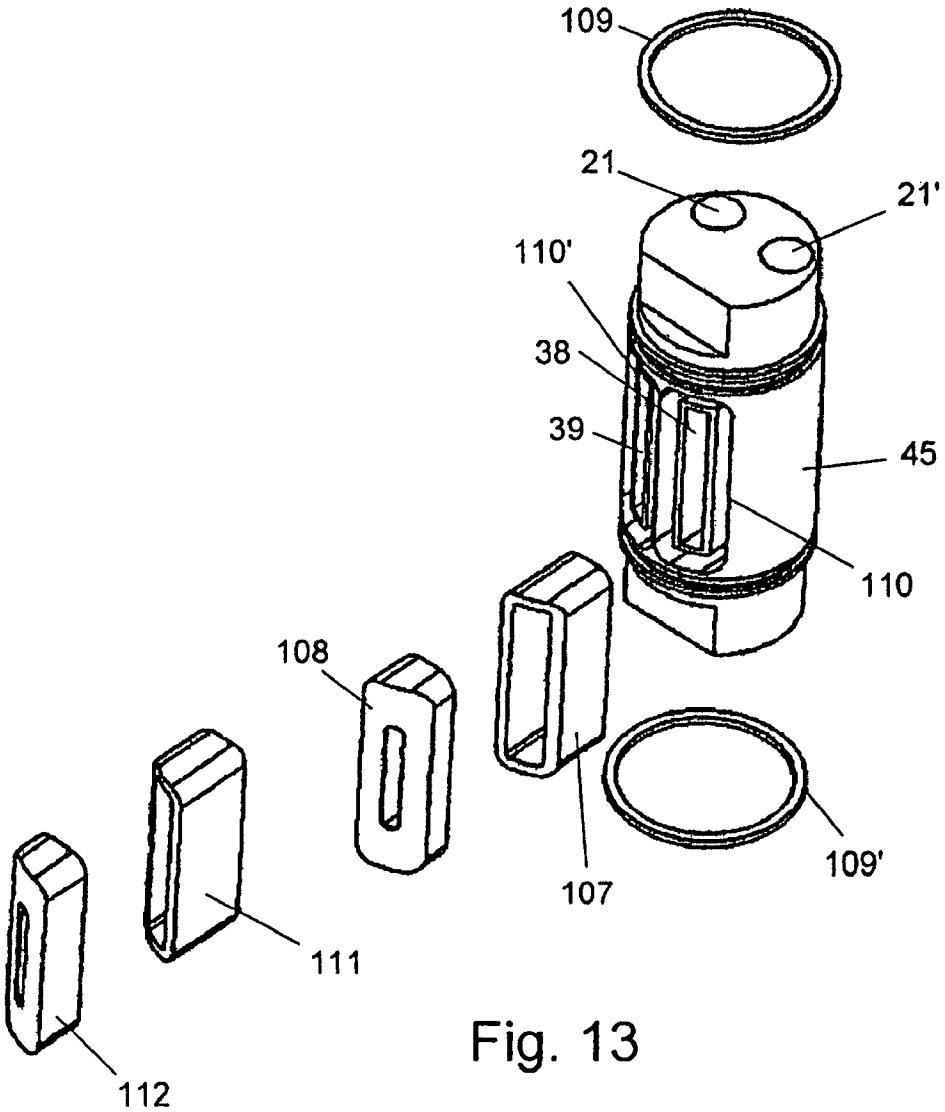
FIG. 13 illustrates in perspective view a variant of the valve of FIG. 5, which relates to a motor that rotates in two directions.
Figure 14:
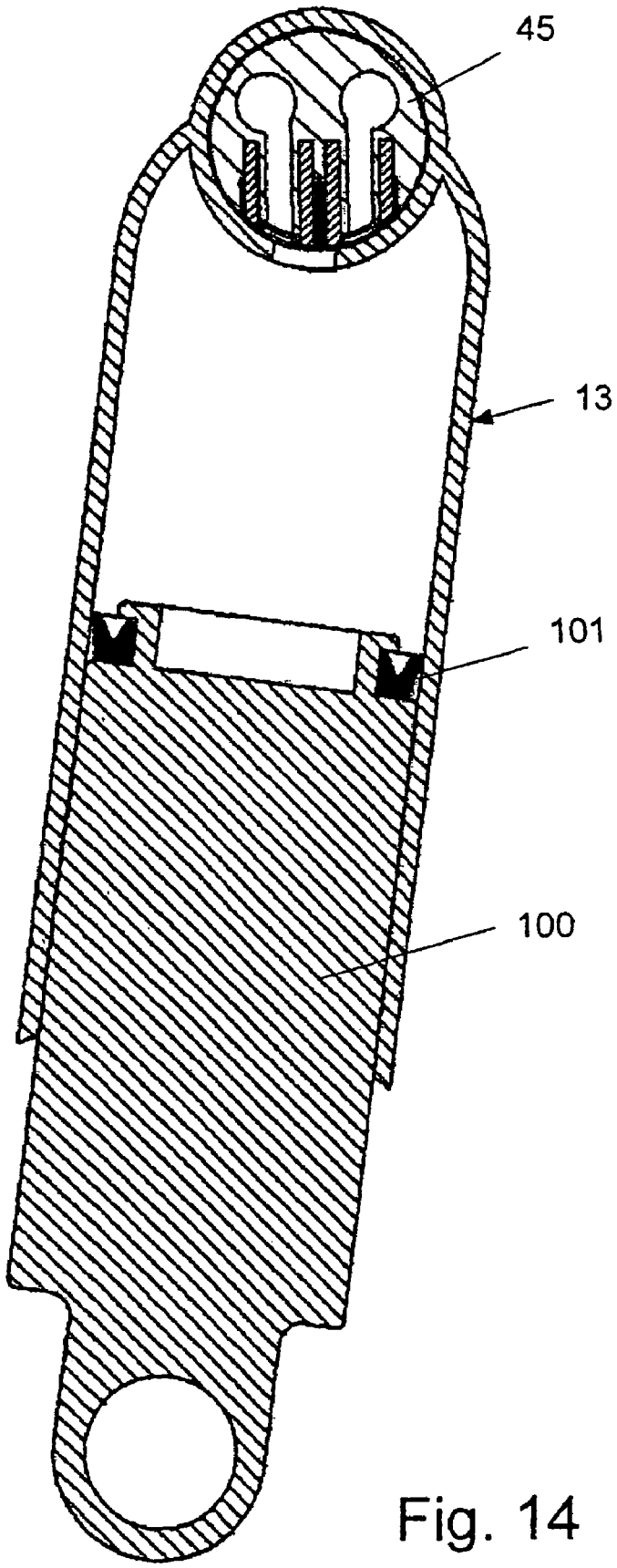
FIG. 14 is a schematic cross-section analogous to FIG. 3, but embodying the valve of FIG. 13.
Figure 15:
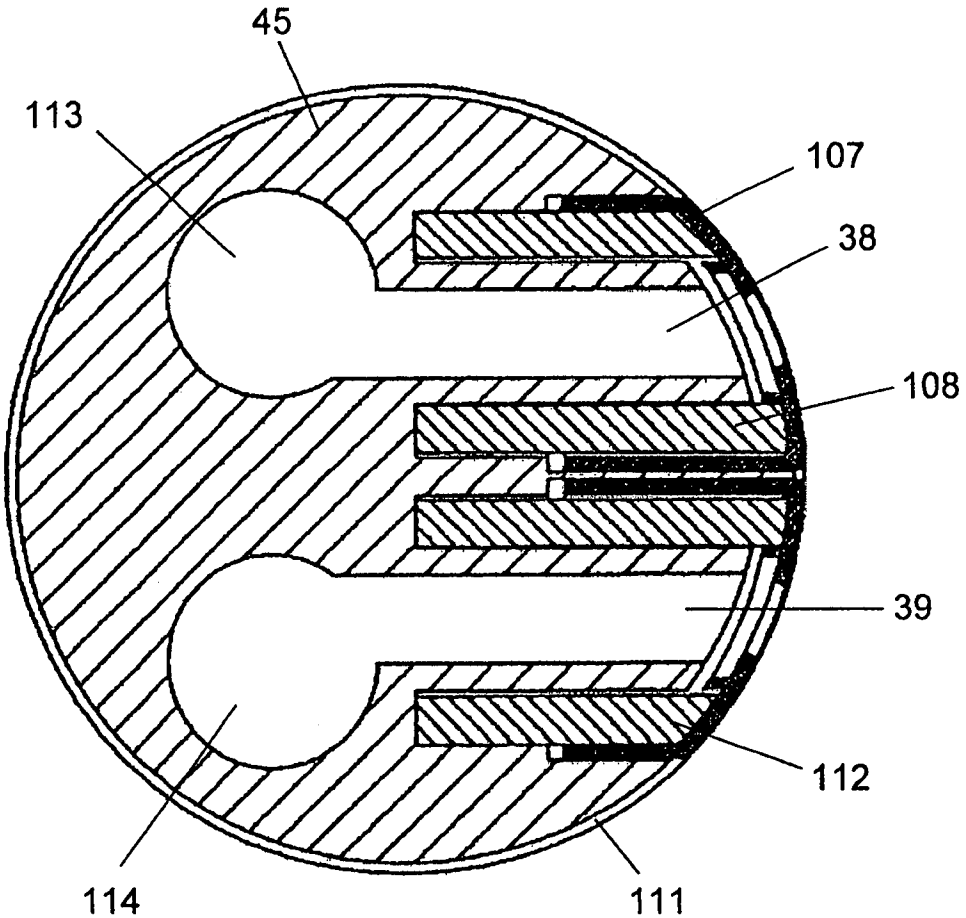
FIG. 15 is an enlarged cross-section of the valve of FIG. 14.

If the shaft driven by the mechanism always rotates the same direction, fluid and only one seal is required. If the shaft driven by the mechanism alternatively rotates in opposite directions, both valve body ports alternatively communicate with the source of pressure fluid and both must be provided with a seal-cap unit as hereinbefore described. This is illustrated in the exploded perspective of FIG. 13, in the cross-section of FIG. 14, and in the enlarged partial cross-section of FIG. 15. In FIG. 13, the valve body 45 is provided with two ports 21 and 21' for communication with a fluid source and with a discharge respectively. Two elastomeric seal rings 109 and 109' are mounted on said body. Two openings 110 and 110' of the valve body accommodate two apertures 38 and 39. For aperture 38, are provided elastomeric sleeve 107 and rigid cap 108, having the functions described in connection with FIG. 5. Similar elastomeric sleeve 111 and rigid cap 112 are provided to carry out the same functions for aperture 39. Opening 110 of the valve body can be broad enough to accommodate two apertures 38 and 39. In such configuration, elastomeric sleeves 107 and 111, and rigid caps 108 and 112, could be connected to form a single elastomeric sleeve and/or a single rigid cap. FIG. 14 is an axial cross-section of the connecting rod assembly and a transverse cross-section of the valve. The connecting-rod assembly 13 is the same as in, FIG. 11 but the piston 100 is provided with an elastomeric seal 101, as in FIG. 11. The valve body, 45 is better seen in FIG. 15, which is an enlarged cross-section thereof, taken across apertures 38 and 39. 113 and 114 are two channels through which said apertures communicate with port 21 and, a corresponding port on the other side of the valve body. The two elastomeric sleeves are seen at 107 and 111 and the two rigid caps at 108 and 112.

Figure 6:
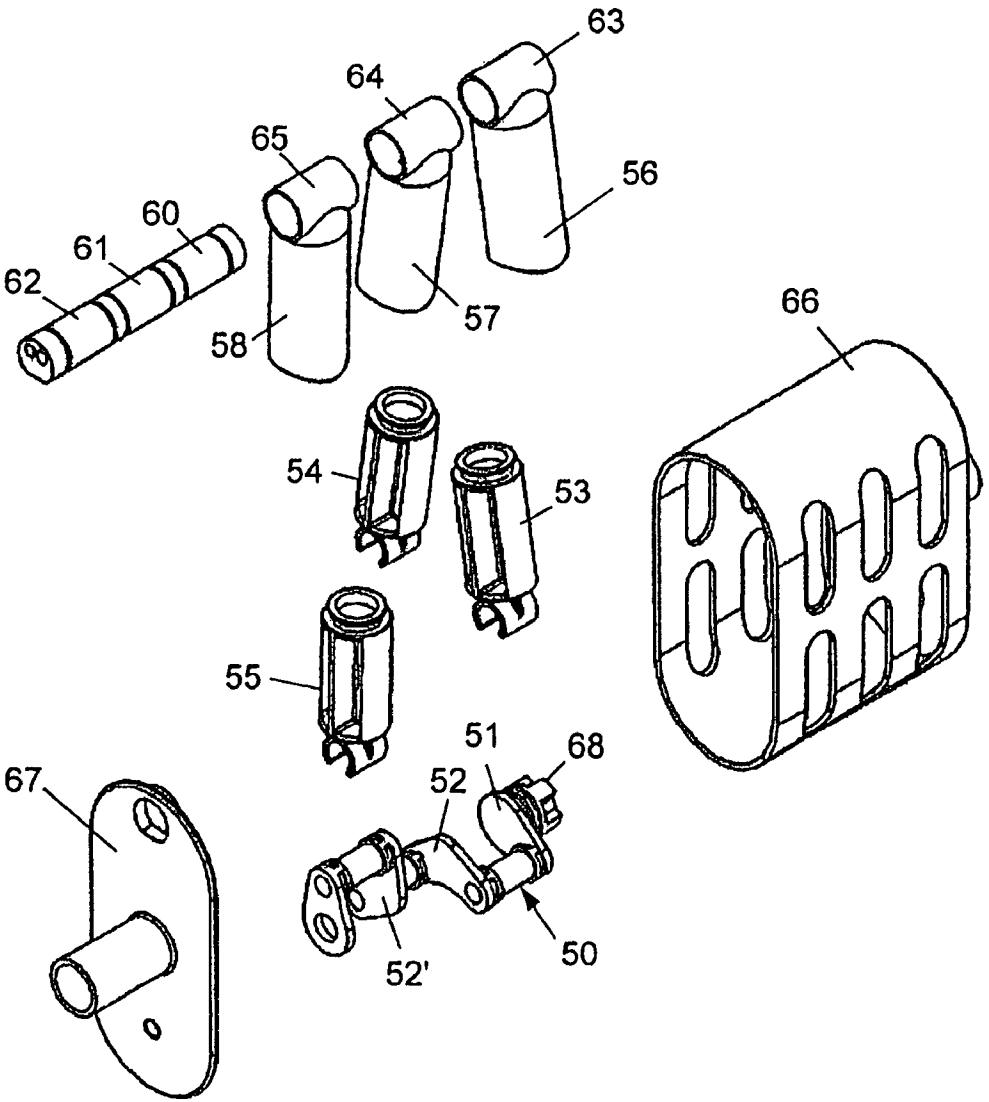
FIGS. 6 and 7 illustrate an embodiment of the invention in which the connecting-rod assemblies and the valves are spaced linearly.
Figure 7:
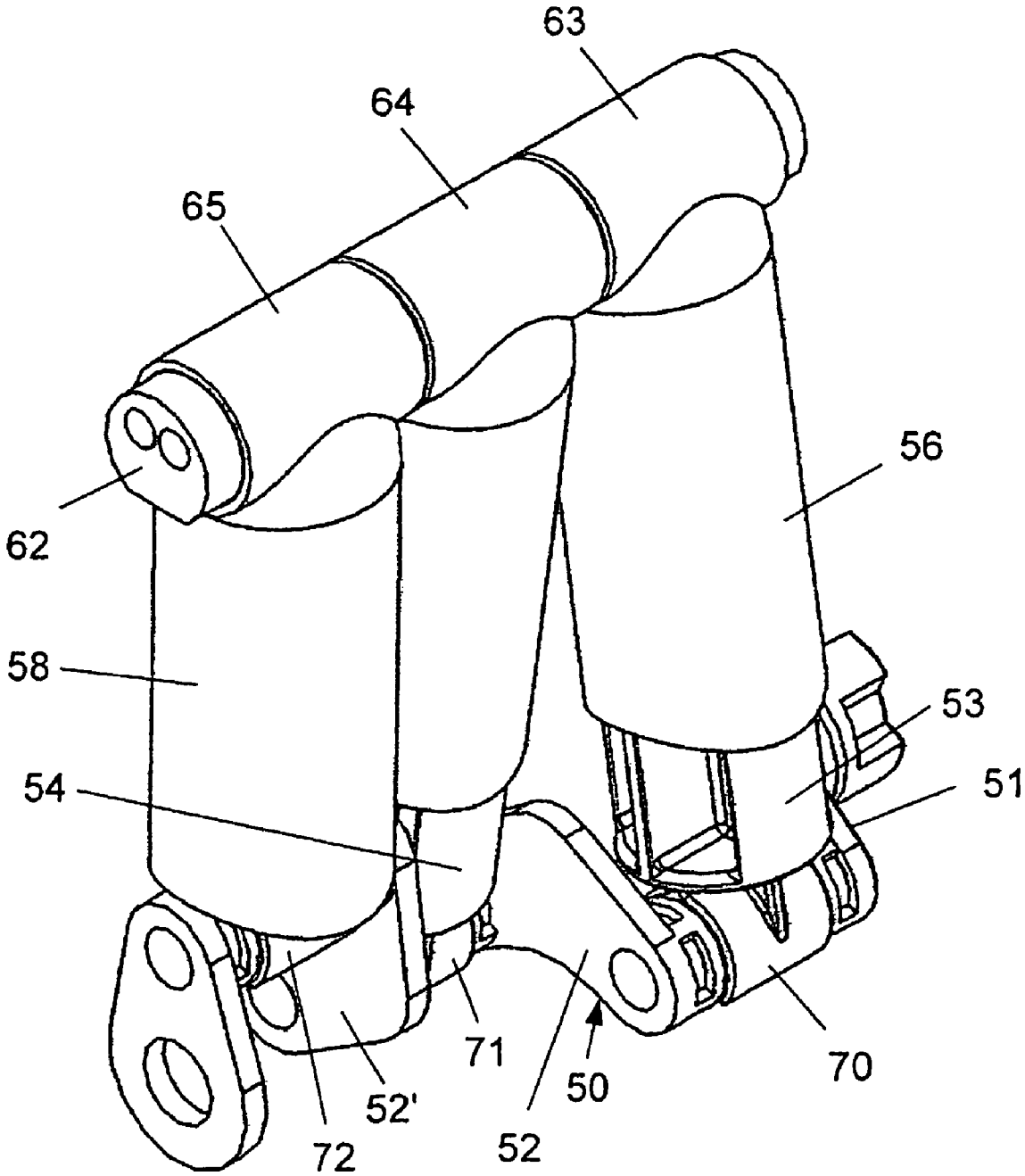

FIGS. 6 and 7 illustrate an embodiment of the invention in which the cranks are part of a crankshaft and the connecting-rod assemblies and the valves are spaced linearly, perpendicularly to their axes in the null angle positions. In FIG. 6, numeral 50 indicates a crankshaft which comprises three cranks 51, 52 and 52'. Corresponding to each of said cranks, the apparatus comprises three connecting-rod assemblies, which comprise pistons 53, 54 and 55, and cylinders 56, 57 and 58. Said assemblies are similar to those of the embodiment previously described. Valve 60, 61 and 62, similar to those hereinbefore described, serve as pivots of the connecting-rod assemblies, being inserted respectively into sleeves 63, 64 and 65. Valves 60, 61 and 62 can be designed as one unit. Numeral 66 indicates a cover element overlapping the apparatus and 67 is a plate attached to one end of over 66, provided with a projection that serves as a support to engage a stationary frame. 68 is a shaped projection for engaging the crankshaft 50 to any chosen driven apparatus.

FIG. 7 shows in perspective view the assembly of the crankshaft, the connecting-rod assemblies with their terminal sleeves and the valves, not visible because enclosed in the terminal sleeves. This figure also shows at 70, 71 and 72 the pivotal connections between the pistons and the crankshaft. In FIG. 7, the device is shown in different angular positions of the three connecting-rod assemblies. Piston 53 is approximately at the end of its positive stroke and piston 72 is at or near the end of its negative stroke.

Figure 8:
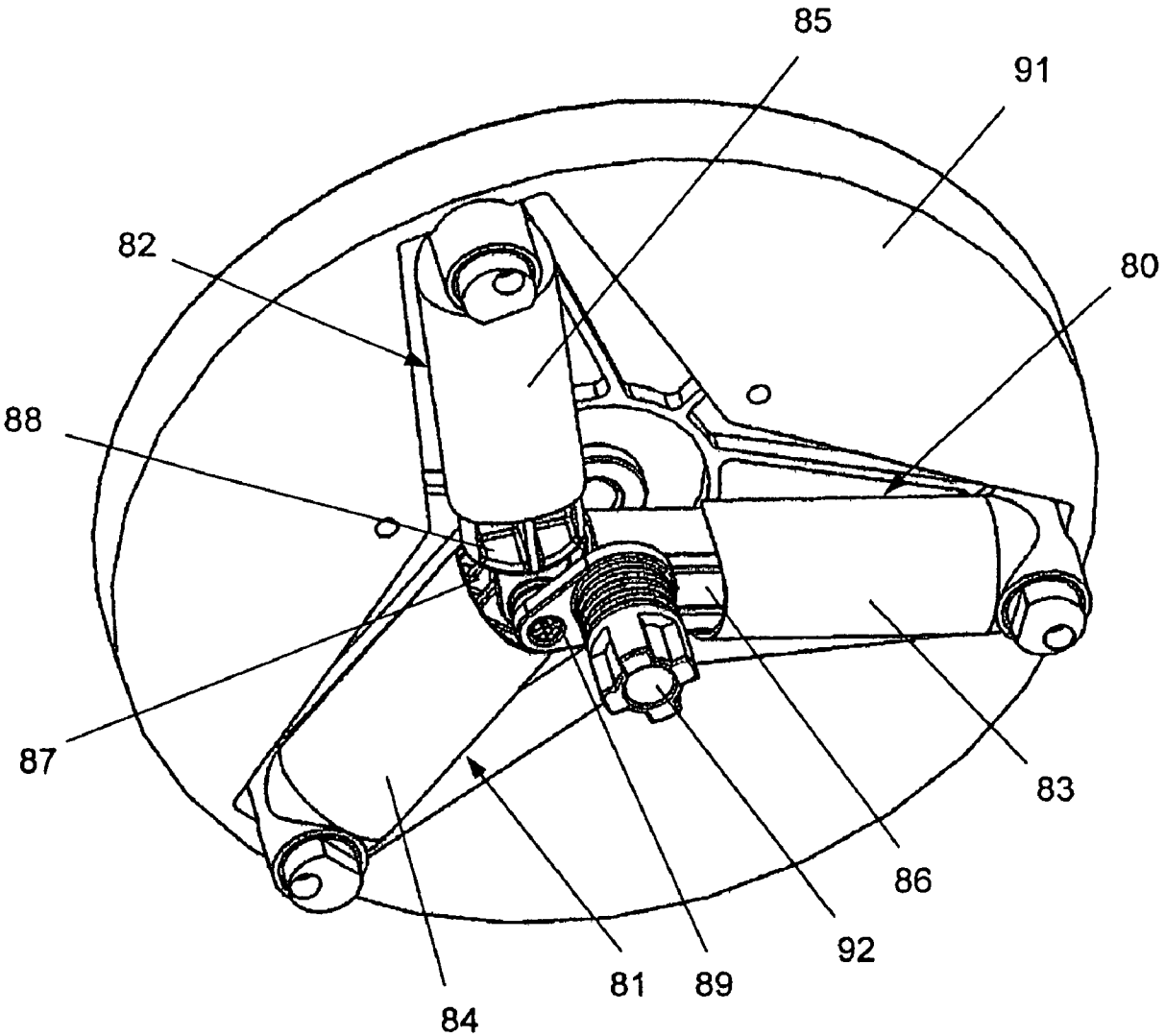
FIGS. 8 and 9 illustrate an embodiment of the invention which comprises three angularly spaced connecting-rod assemblies.
Figure 9:
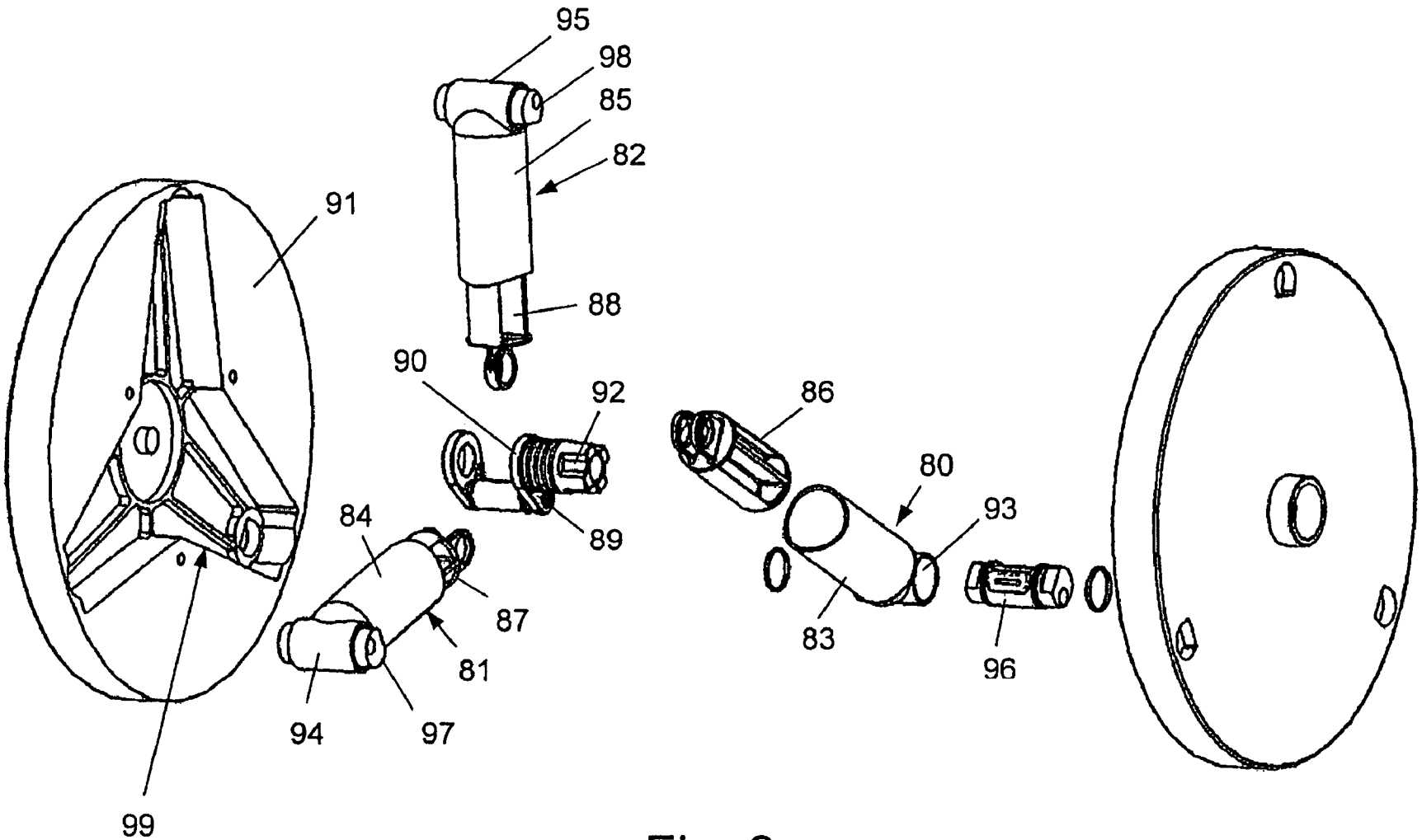

FIGS. 8 and 9 illustrate in perspective view an embodiment of the device which comprises the three connecting-rod assemblies 80, 81 and 82. They comprise three cylinders 83, 84 and 85 respectively and pistons 86, 87 and 88 respectively. The crank which they drive is identified by numeral 89 and is solid with or keyed to shaft 92. 91 indicates a supporting plate. In FIG. 9 the device is shown in exploded perspective view, in which the crankshaft 90 is clearly visible. The three cylinders 83, 84 and 85 of the connecting-rod assemblies are provided with transverse sleeves 93, 94 and 95, respectively for housing valves 96, 97 and 98 respectively. The valves are supported on a trilateral support 99 attached to a support plate 91.

Figure 10:
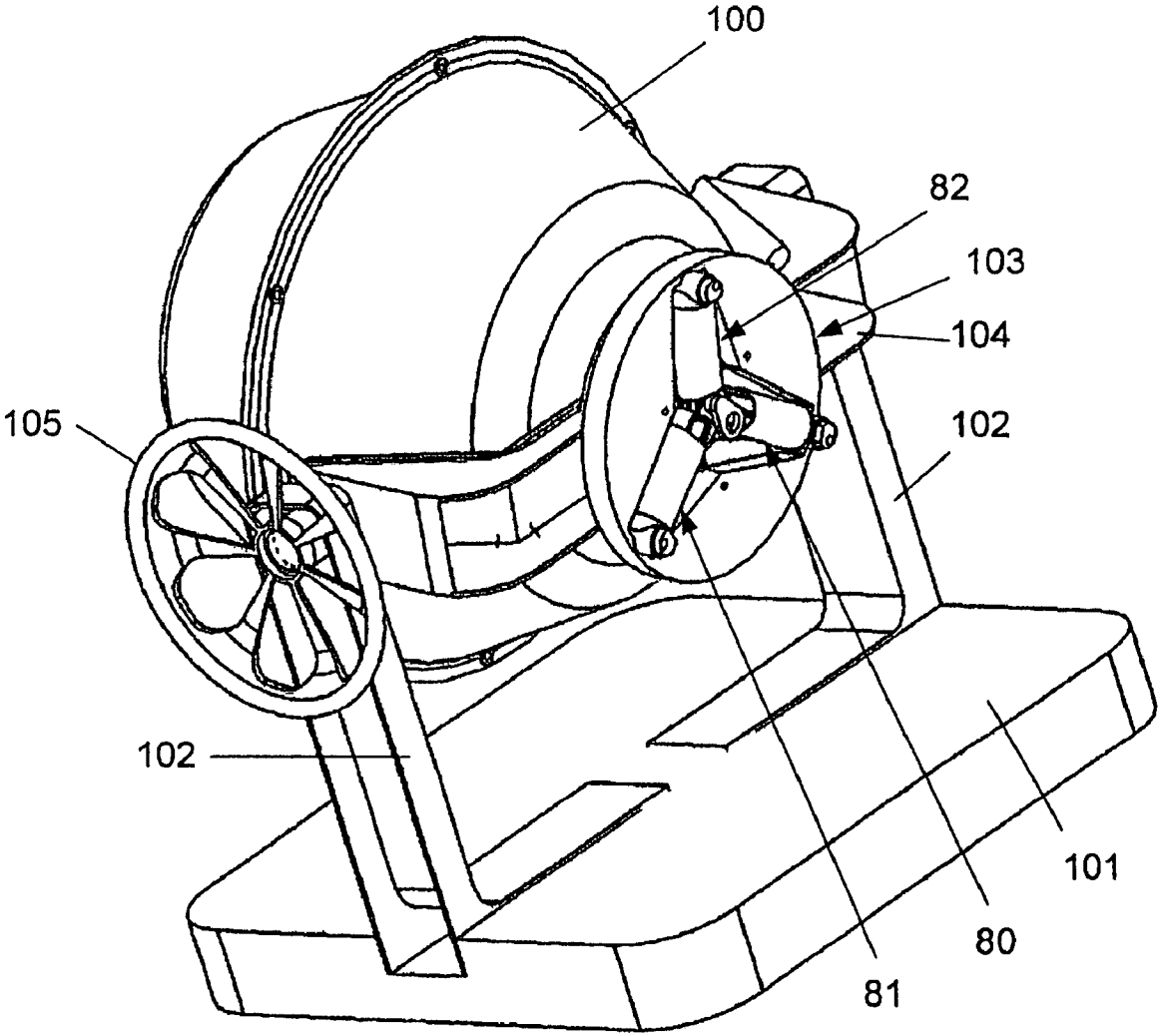
FIG. 10 illustrates in perspective view the use of the apparatus of FIGS. 8 and 9 in a mixer.

FIG. 10 illustrates in perspective view an embodiment in which the apparatus of FIGS. 8 and 9 is used to drive a cement mixer 100. The cement mixer is supported on a base 101 by means of legs 102, to which the axis of the cement mixer is pivoted. The device according to the invention, such as illustrated in FIGS. 8 and 9, is generally indicated at 103 and is supported on a transverse bar 104. The three connecting-rod assemblies are visible and indicated by the said numerals 80, 81 and 82, as in FIG. 9. A handle 105 permits to rotate the mixer manually, as may be required to place it in an angular position, for loading or unloading.

Figure 16:
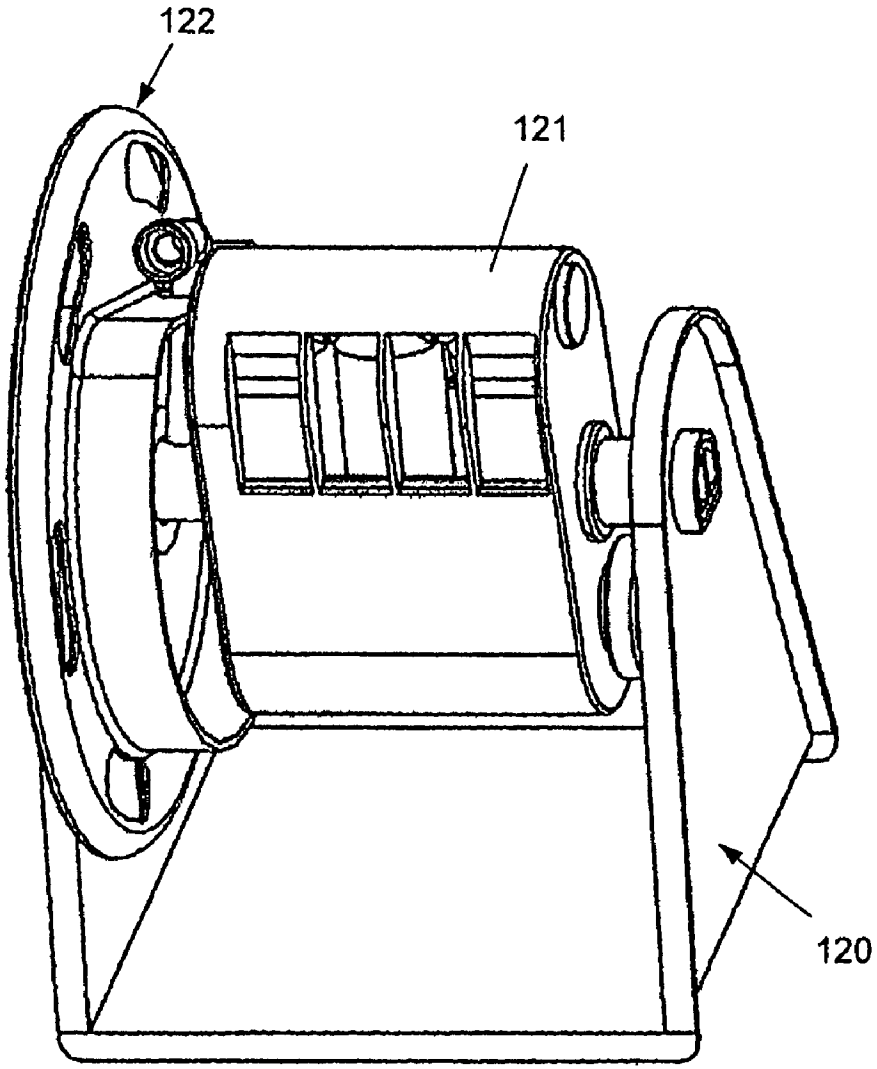
FIG. 16 illustrates in schematic perspective view a use of the embodiment of FIGS. 6 and 7 in a hose reel.

FIG. 16 shows in perspective view a mechanism such as that of FIGS. 6 and 7, mounted on a garden hose reel with a stationary stand 120. The mechanism is provided with a cover. 121, partly broken off to show part of the connecting-rod assemblies. 122 generally indicates the driven reel of the hose reel. In this configuration, the mechanism/motor according to the invention is located inside the reel.

Figure 17:
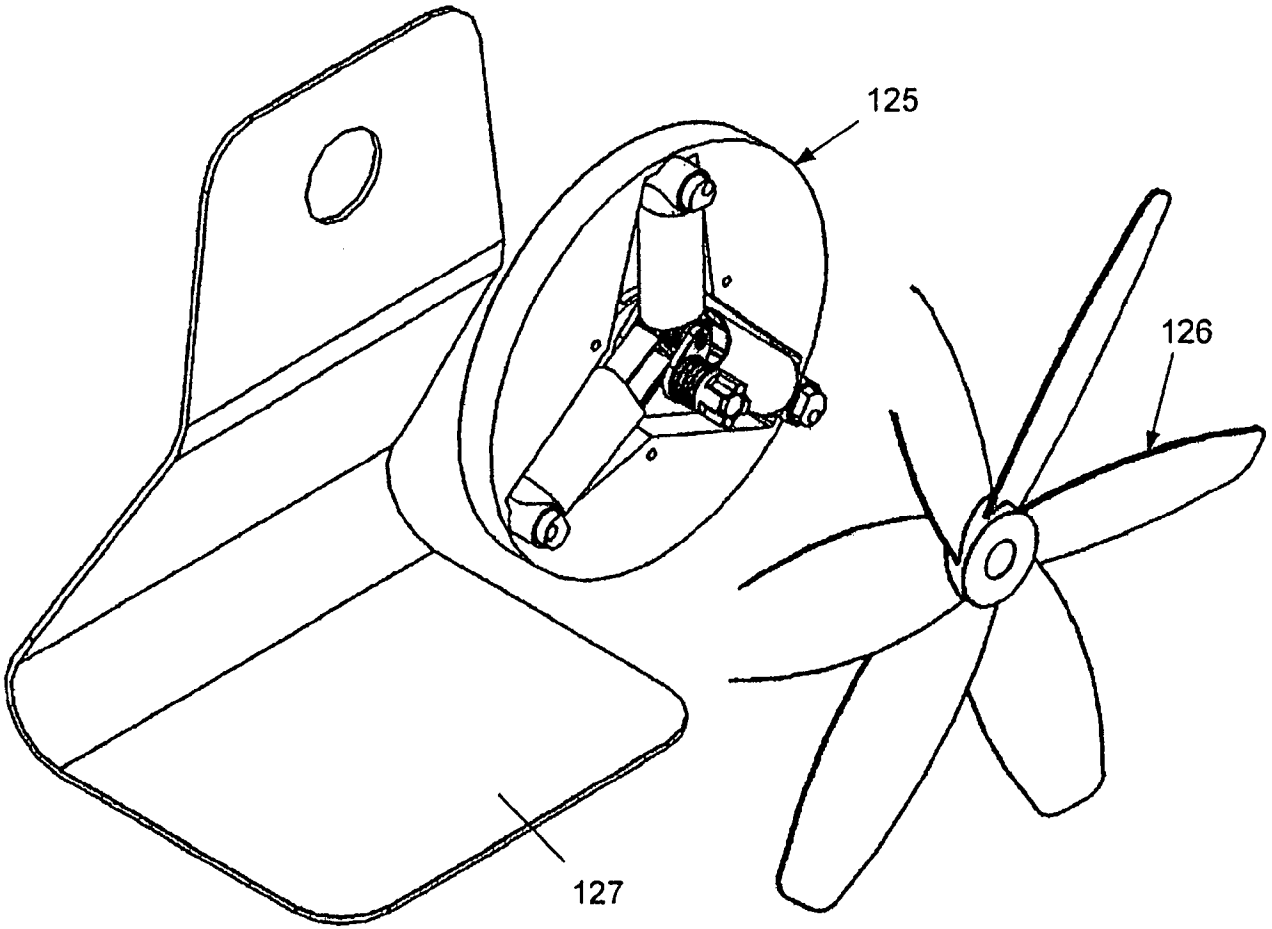
FIG. 17 illustrates in schematic perspective view a use of the embodiment of FIGS. 8 and 9 in a fan.

FIG. 17 illustrates in exploded perspective view the use of a mechanism such as that of FIGS. 8 and 9 for driving a fan schematically indicated at 126. Mechanism 125 is supported on a stand 127.

While specific embodiments have been shown by way of illustration, it should be understood that the invention can be carried out with many modifications, variation and adaptations, without departing from its spirit or exceeding the scope of the claims.

The invention claimed is:

1. A fluid-driven engine, comprising:

a drive unit connectable to a source of pressurized fluid and including a piston movable within a cylinder;

a valve assembly controlling the introduction of pressurized fluid into said cylinder, and the discharge of spent fluid therefrom for driving said piston with respect to said cylinder;

and a rotatable drive shaft including a crank arm coupled to said drive unit for rotating said drive shaft about a rotary axis;

said piston projecting through one end of said cylinder and being pivotally coupled to said crank arm for rotating said drive shaft during forward and return strokes of the piston with respect to the cylinder;

the opposite end of said cylinder being pivotally mounted to said valve assembly so as to oscillate with said piston between opposite sides of said drive shaft rotary axis during the forward and return strokes of the piston;

said opposite end of the cylinder being formed with a port through which pressurized fluid is introduced and spent fluid is discharged as controlled by said valve assembly during the oscillations of said cylinder and piston;

said valve assembly including a valve body pivotally mounting said opposite end of the cylinder for pivotal movement about the longitudinal axis of the valve body;

said valve body including a rounded surface serving as the pivotal mounting seat for said opposite end of the cylinder and formed with a pair of valve openings spaced from each other so as to be selectively alignable with said port formed in said opposite end of the cylinder during pivotal movements of said cylinder for controlling the introduction of pressurized fluid into the cylinder and the discharge of spent fluid from the cylinder;

said valve body further including a cap for at least one of said valve openings, and an elastomeric sleeve between the valve body and the cap for urging the cap against the surface of said cylinder when pivotally mounted to the valve body.

2. The engine according to claim 1, wherein said valve openings are of relatively long length in the one direction of said rounded surface of the valve body and of relatively narrow width in the transverse direction of said rounded surface of the valve body.

3. The engine according to claim 1, wherein said valve openings are of generally rectangular configuration.

4. The engine according to claim 1, wherein said opposite end of the cylinder is formed with a cylindrical socket receiving said valve body for pivotal movement of the cylinder and piston with respect to the longitudinal axis of the valve body.

5. The engine according to claim 4, wherein said rounded surface of the valve body further includes a pair of sealing rings on the opposite sides of said valve openings.

6. The engine according to claim 1, wherein said valve body includes a cap for each of said valve openings, and an elastomeric sleeve between the valve body and the respective cap for urging the respective cap against the surface of the cylinder when pivotally mounted to the valve body.

7. The engine according to claim 1, wherein said valve body is of cylindrical configuration, and said valve openings are of relatively long length in the axial direction of said valve body and of relatively narrow width in the circumferential direction of said valve body.

8. The engine according to claim 7, wherein said valve body includes a said cap and a said elastomeric sleeve for each of said valve openings.

9. The engine according to claim 1, wherein said crank arm of said drive shaft includes a coupling pin and wherein said one end of the piston is formed with a snap ring configured to be snapped onto said coupling pin.

10. The engine according to claim 1, wherein said crank arm of said drive shaft includes a coupling pin, and wherein said one end of the piston is formed with a coupling ring dimensioned to be rotatably received on said coupling pin.

11. The engine according to claim 1, wherein said engine comprises a plurality of at least three of said drive units each including a piston movable within a cylinder; and a valve assembly for each of said drive units for controlling the introduction of pressurized fluid into the cylinder of the respective drive unit and the discharge of spent fluid therefrom for driving the piston of the respective drive unit; each of said pistons being coupled to said drive shaft such that the pistons initiate their respective forward strokes at different angular positions of the drive shaft.

12. The engine according to claim 11, wherein said pistons are coupled to said drive shaft such as to initiate their respective forward strokes at equally-spaced angular positions of the drive shaft.

13. The engine according to claim 11, wherein said drive units and valve assemblies are each arranged in a linear array, with the valve assembly at one end of the respective drive unit and in abutting relation to the valve assembly of the adjacent drive unit, and with the drive shaft coupled to the pistons at the opposite ends of the drive units.

14. The engine according to claim 13, wherein the pistons of the drive units are coupled to said drive shaft via a crank shaft which includes a crank arm for each piston.

15. The engine according to claim 11, wherein said drive units and valve assemblies are arranged in a radiating array, with the valve assembly at the outer end of the respective drive unit and pivotally coupled to the cylinder of the respective drive unit, and with the drive shaft at the inner ends of all said drive units and coupled to the pistons of all the drive units.

16. The engine according to claim 15, wherein said drive shaft includes a single crank arm to which the pistons of all the drive units are pivotally coupled.

17. A fluid-driven engine, comprising:

at least three drive units connectable to a source of pressurized fluid; each of said drive units including:

a piston movable within a cylinder;

a valve assembly controlling the introduction of pressurized fluid into the cylinder of each drive unit, and the discharge of spent fluid therefrom for driving the piston of the respective drive unit; and a rotatable drive shaft coupled to said drive units for rotating the drive shaft about a rotary axis;

each of said pistons projecting through one end of its respective cylinder and being coupled to said drive shaft for rotating said drive shaft during forward and return strokes of the pistons with respect to their cylinders;

the opposite ends of the cylinders being pivotally mounted to their respective valve assemblies so as to oscillate with their respective pistons between opposite sides of the drive shaft rotary axis during the forward and return strokes of the pistons;

the opposite end of each of the cylinders being formed with a port through which pressurized fluid is introduced and spent fluid is discharged as controlled by the respective valve assembly during the oscillations of the cylinders and pistons;

said pistons of the drive units being coupled to the drive shaft such as to initiate their respective forward strokes at different angular positions of the drive shaft;

each of said valve assemblies including a valve body of cylindrical configuration pivotally mounting said opposite end of the cylinders for pivotal movement about the longitudinal axis of the valve body;

said valve body including a cylindrical surface serving as the pivotal mounting seat for said opposite end of the cylinder and formed with a pair of valve openings circumferentially spaced from each other so as to be selectively alignable with said port formed in said opposite end of the cylinder during pivotal movements of said cylinder for controlling the introduction of pressurized fluid into the cylinder and the discharge of spent fluid from the cylinder;

said valve body further including a cap for at least one of said valve openings, and an elastomeric sleeve between the valve body and the cap for urging the cap against the surface of said cylinder when pivotally mounted to the valve body.

18. The engine according to claim 17, wherein each of said valve openings is of relatively long length in the axial direction of said cylindrical surface of the valve body and of relatively narrow width in the circumferential direction of said cylindrical surface of the valve body.

19. The engine according to claim 18, wherein the pistons of the drive units are coupled to said drive shaft via a crank shaft which includes a crank arm for each piston.

20. The engine according to claim 17, wherein said pistons are coupled to said drive shaft such as to initiate their respective forward strokes at equally-spaced angular positions of the drive shaft.

21. The engine according to claim 17, wherein said drive units and valve assemblies are each arranged in a linear array, with the valve assembly at one end of the respective drive unit and in abutting relation to the valve assembly of the adjacent drive unit, and with the drive shaft coupled to the pistons at the opposite ends of the drive units.

22. The engine according to claim 17, wherein said drive units and valve assemblies are arranged in a radiating array with the valve assembly at the outer end of the respective drive unit and pivotally coupled to the cylinder of the respective drive unit, and with the drive shaft at the inner ends of all said drive units and coupled to the pistons (86, 87, 88) of all the drive units.

23. The engine according to claim 22, wherein said drive shaft includes a single crank arm to which the pistons of all the drive units are pivotally coupled.

* * * * *